US008651652B2

(12) United States Patent
Kelly et al.

(10) Patent No.: US 8,651,652 B2
(45) Date of Patent: Feb. 18, 2014

(54) PIVOTABLE INK CARTRIDGE PLATFORM FOR PRINTER DEVICE

(75) Inventors: Kieran B Kelly, Vancouver, WA (US); Shawn Michael Close, Portland, OR (US); Prodpran Suetrong, Bangkok (TH); Mark G Miranda, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 35 days.

(21) Appl. No.: 13/457,667

(22) Filed: Apr. 27, 2012

(65) Prior Publication Data

US 2013/0286111 A1 Oct. 31, 2013

(51) Int. Cl.
*B41J 2/01* (2006.01)

(52) U.S. Cl.
USPC ..... 347/101

(58) Field of Classification Search
USPC ..... 347/4, 20, 101, 104, 105, 153, 218, 347/220, 221, 245, 262–264
See application file for complete search history.

(56) References Cited

U.S. PATENT DOCUMENTS

| | | | | |
|---|---|---|---|---|
| 6,247,805 | B1 | 6/2001 | Iwaya | |
| 6,499,826 | B1 | 12/2002 | Kline et al. | |
| 6,948,798 | B2 | 9/2005 | Kline et al. | |
| 7,018,034 | B2 | 3/2006 | Rasmussen et al. | |
| 7,641,331 | B2 | 1/2010 | Chen | |
| 7,677,556 | B2 * | 3/2010 | Murayama et al. | 271/162 |
| 2005/0082739 | A1 * | 4/2005 | Mitsuya et al. | 271/10.11 |
| 2006/0239752 | A1 * | 10/2006 | Shiraishi et al. | 400/691 |
| 2011/0310184 | A1 | 12/2011 | Nakamura | |

FOREIGN PATENT DOCUMENTS

| | | | |
|---|---|---|---|
| EP | 1837183 | A1 | 9/2007 |
| WO | WO 2007/037451 | A1 | 4/2007 |

* cited by examiner

*Primary Examiner* — Hai C Pham

(57) ABSTRACT

A printer device includes a housing (32) that defines an interior space. A platform (36) includes a first position extending along a plane within the interior space for receiving media to be printed with fluid. A mechanism (200) selectively applies a force to the platform (36) to move the platform (36) to a second position at an angle relative to the plane.

19 Claims, 8 Drawing Sheets

FIG. 3

PIVOTABLE INK CARTRIDGE PLATFORM FOR PRINTER DEVICE

TECHNICAL FIELD

The present disclosure relates to printer devices and, in particular, relates to a printer device that places an ink cartridge in a user-friendly position for removal and replacement.

BACKGROUND

In inkjet printers, there is a printhead or thermal or electromechanical device which deposits or prints ink onto the media, e.g., paper. There are also user-replaceable ink cartridges, which supply the ink required for printing. The replaceable ink cartridges may include that printhead or may supply ink to a permanent printhead. In low-end inkjet printers, these replaceable ink cartridges tend to be mounted on the carriage that scans over the media during printing. In these low-end inkjet printers, the replaceable ink cartridges are generally replaced from the top of the printer, the front of the printer, i.e., the side towards the outcoming printed paper, or somewhere in between. Because of the requirement for the replaceable ink cartridges to connect to the printer reliably and accurately, there are constraints on the kinematics on installing the replaceable ink cartridge.

Where the replaceable ink cartridges are installed generally from above, e.g., within the printzone and associated starwheel structure, either an articulated scanner (in an all-in-one printer) or cover (in a single function printer) is required, which adds cost. It also requires access from above, which can pose problems with accessibility and visibility if the printer is mounted on a shelf. Furthermore, physical constraints of the starwheels and the starwheel structure can conflict with the kinematic requirements of engaging the replaceable ink cartridge in the carriage. This can limit the allowable size and/or shape of the replaceable ink cartridge. This type of installation also typically leads to a kinematic path, which is not apparent to an uninformed printer user, requiring mysterious rotations and translations of the replaceable ink cartridge during installation.

Where the replaceable ink cartridges are installed generally from the front, e.g., to the left or right of the printzone and associated starwheel structure, an opening door is required at or near one corner of the printer, which adds cost for the door and for structural components to strengthen the corner of the printer base. Furthermore, the area to the left and right of the printzone is often used for mechanisms which maintain the health of the printhead, e.g., capping, wiping, spitting and/or priming, and replacing the ink cartridges there may add complexity, cost or additional size to those mechanisms.

In other front installation printers, the physical constraints of the starwheels and the starwheel structure can conflict with the kinematic requirements of engaging the replaceable ink cartridge in the carriage. This can limit the allowable size and/or shape of the replaceable ink cartridge. It also typically leads to a kinematic path which is not apparent to an uninformed printer user, requiring mysterious rotations and translations of the replaceable ink cartridge during installation.

SUMMARY

In accordance with an embodiment of the present disclosure a printer device includes a housing that defines an interior space. A platform has a first position extending along a plane within the interior space for receiving printing media. A mechanism selectively applies a force to the platform to move the platform to a second position at an angle relative to the plane.

In accordance with another aspect of the present disclosure, a printer device includes a housing that defines an interior space. A door is connected to the housing and is selectively rotatable between a first position that encloses the interior space and a second position that provides access to the interior space. A platform has a first location that extends along a plane within the interior space for receiving printing media. The platform has a cartridge receiving opening capable of receiving a cartridge. A mechanism is secured to the door for selectively engaging the platform to rotate the platform to a second location at an angle relative to the plane in response to rotation of the door to the second position. Rotating the platform to the second location angles the cartridge receiving opening downwards relative to the plane.

In accordance with another aspect of the present disclosure, a method of increasing the accessibility of an ink cartridge in a printer device includes providing a platform having an ink cartridge receiving opening capable of receiving the ink cartridge, the platform having a first position extending along a plane within a housing of the printer device. A linkage mechanism connects the platform to a door of the printer device that selectively provides access to the ink cartridge. The door is opened to cause the linkage mechanism to apply a force upon the platform in order to urge the platform into a second position at an angle relative to the plane, wherein moving the platform to the second position angles the ink cartridge receiving opening downwards relative to the plane.

Other objects and advantages and a fuller understanding of the disclosure will be had from the following detailed description of the preferred embodiments and the accompanying drawings.

DETAILED DESCRIPTION

Figure 1:
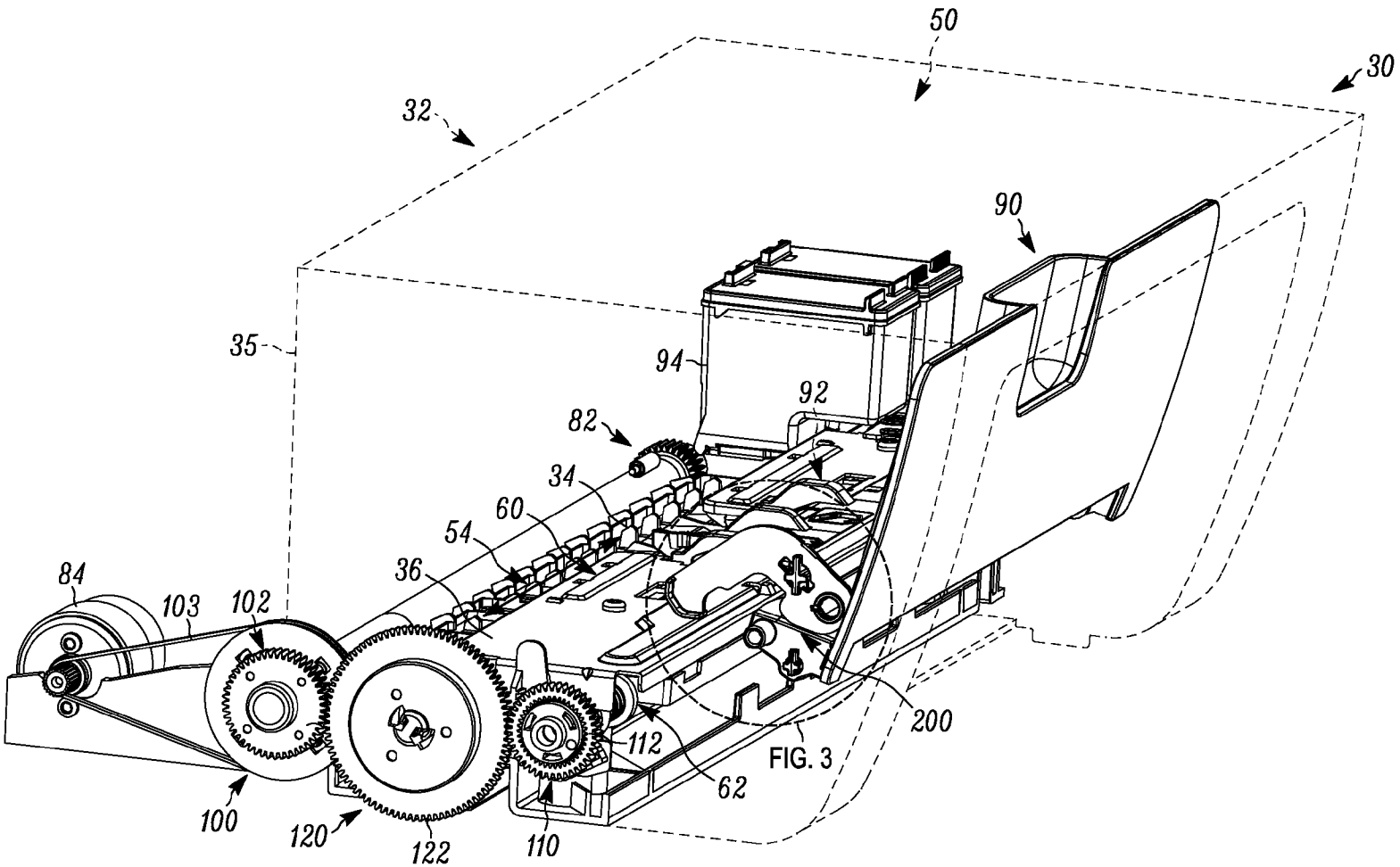
FIG. 1 is a schematic illustration of a printer device in accordance with an example embodiment of the present disclosure.
Figure 2:
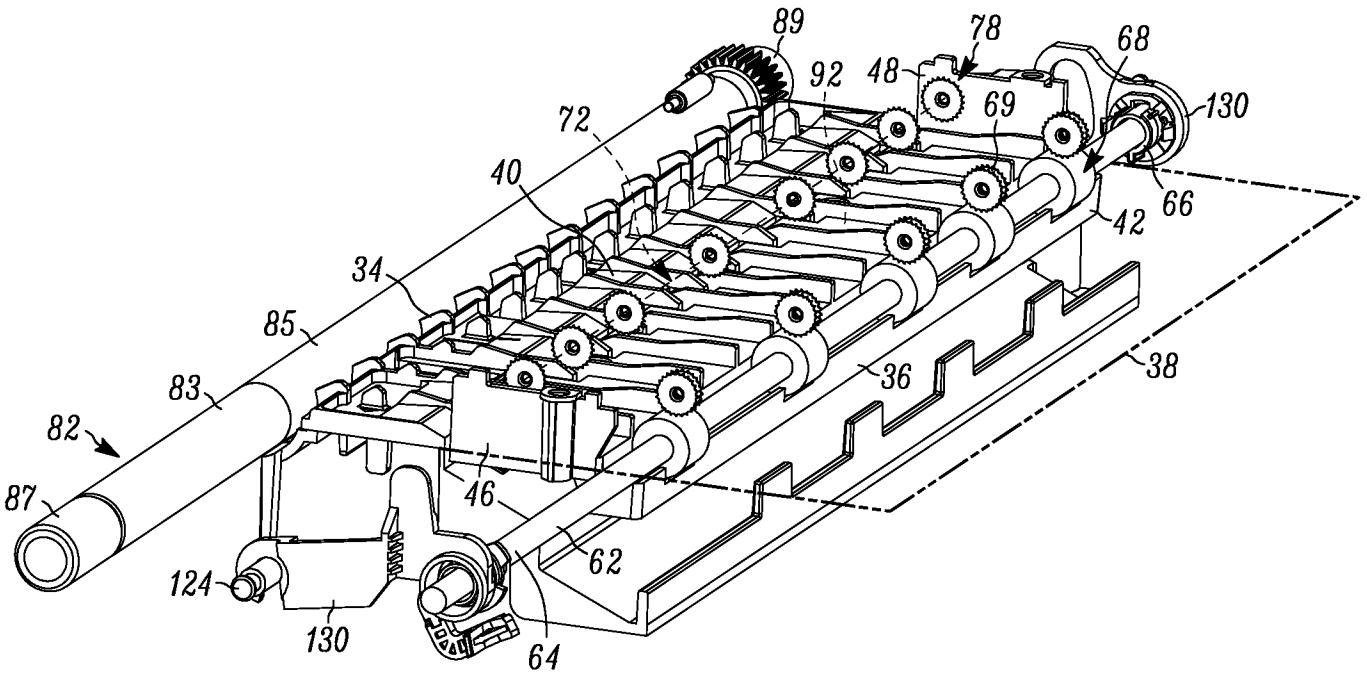
FIG. 2 is a schematic illustration of a portion of the printer device of FIG. 1 with the door in a closed condition.
Figure 3:
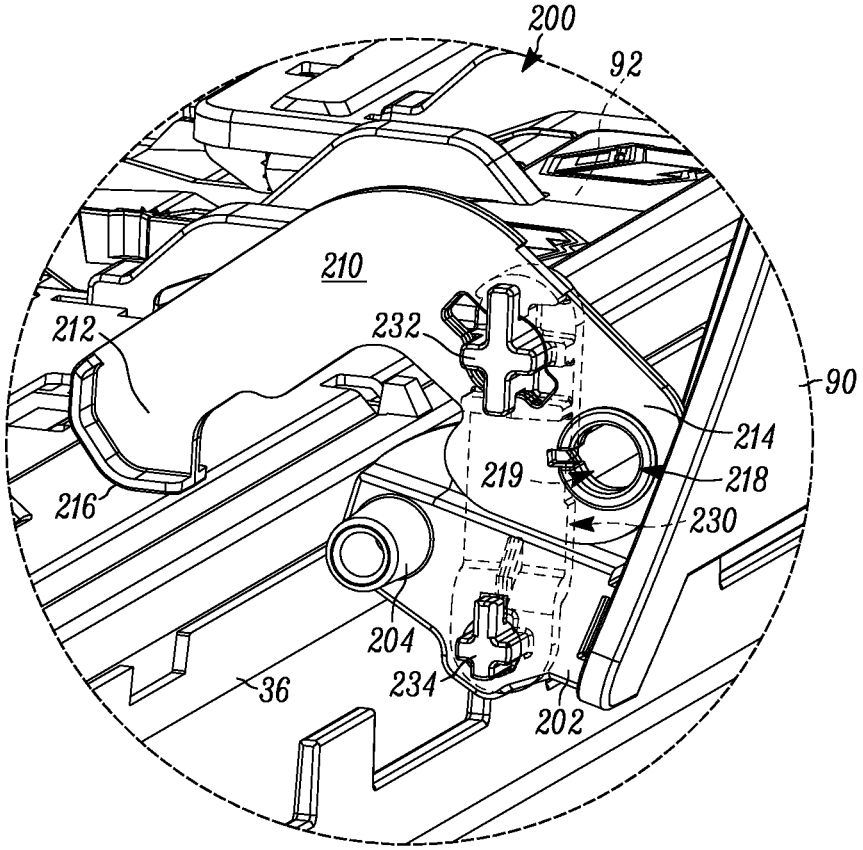
FIG. 3 is a schematic illustration of a mechanism of the printer device of FIG. 1 when the door is in the closed condition.

The present disclosure relates to printer devices and, in particular, relates to a printer device that places a fluid cartridge in a user-friendly position for removal and replacement. FIG. 1 illustrates a printer device 30 in accordance with an example embodiment of the present disclosure. It should be appreciated that the printer device 30 is intended to be any type of fluid dispensing device, including for example titration dispensing equipment that may use a consumable or replaceable fluid containing element, such as a cassette or cartridge. Such fluids may include, but are not limited to printing fluids.

The printer device 30 includes a generally rectangular housing 32 that defines an interior space 50. The housing 32 includes a base 34 connected to a plurality of walls, illustrated in phantom by reference number 35, for defining the interior space 50. A door 90 is pivotally connected to the housing 32 and is movable between an open condition providing access to the interior space 50 and a closed condition (as shown) preventing access to the interior space. An upstream end of the printer device 32 (the left as viewed in FIG. 1) receives media from a tray or other source and delivers the media to a printing zone 54 in the interior space 50 where the media is printed with fluid from one or more fluid containing elements 94. In the illustrated example embodiment, the fluid containing element 94 is an ink cartridge. The printed media is delivered downstream out of the printer device 32 to be received by the user.

A platform 36 is connected to the base 34 and extends along a plane 38 from a first end 40 to a second end 42 and laterally from a first side 46 to a second side 48. The platform 36 includes an opening 92 for receiving each ink cartridge 94 and is pivotable relative to the base 34 between a first position within or substantially parallel to the plane 38 and a second position at an angle relative to the plane in order to make the ink cartridge opening more accessible to the user. The opening 92 constitutes a pass-through or clearance opening in the platform 36 that receives the ink cartridge 94 to allow the ink cartridge to ultimately be received by a cartridge carrier or receiving carriage (not shown). The cartridge carrier retains the ink cartridge 94 and allows the ink cartridge to scan over the printing zone 54 between the first and second lateral sides 46, 48 of the platform 36 during the printing operation. One or more springs (not shown) extend between the platform 36 and the housing 32 and bias the platform into the first position.

A feed roller 82 is mounted on and rotatable relative to the base 34 for delivering media to the platform 36 to be printed in the printing zone 54. The feed roller 82 extends from a first end 87 to a second end 89 and extends generally from the first side 46 to the second side 48 of the platform 36. The feed roller 82 may have a circular shape and includes an outer surface 83 configured or adapted to grip incoming media. The outer surface 83 may be chemically and/or mechanically treated to facilitate gripping of the media. Alternatively, a rubber or tacky sheath (not shown) may be provided over the outer surface 83.

The first end 87 of the feed roller 82 is non-rotatably secured to a first gear 100 such that rotation of the first gear results in rotation of the feed roller. The first gear 100 includes a plurality of gear teeth 102. Although one first gear 100 is shown secured to the first end 87 of the feed roller 82 it will be appreciated that a first gear may be secured to either or both ends 87, 89 of the feed roller (not shown). In any case, a motor 84 mechanically coupled to the first gear 100 via an endless belt 103 drives the first gear, which results in rotation of the feed roller 82.

An output shaft 62 is mounted on and rotatable relative to the platform 36 and cooperate with the feed roller 82 in order to pass media through the printing zone 54 and ultimately out of the printer device 32 to the user. The output shaft 62 is connected to and movable with the platform 36 and extends from a first end 64 to a second end 66 generally from the first side 46 to the second side 48 of the platform. The shaft 62 therefore extends substantially parallel to the feed roller 82. The first end 64 of the shaft 62 is non-rotatably secured to a second gear 110 such that rotation of the second gear results in rotation of the shaft. The second gear 110 includes a plurality of gear teeth 112. Although only one second gear 110 is illustrated secured to the first end 64 of the shaft 62 it will be appreciated that a second gear may be secured to either or both ends 64, 66 of the shaft (not shown).

A plurality of rollers 68 is secured to and rotatable with the shaft 62. The rollers 68 are spaced from one another along the length of the shaft between the ends 64, 66. Each of the rollers 68 is rubber and has a smooth outer surface. A pair of starwheel rollers 69 is associated with each roller 68 and is configured to grip incoming media to pass the media out of the printing zone 54 to the user. Each pair of starwheels 69 is supported on a spring axle (not shown) contained on the platform 36. The spring axles urge the starwheels 69 into engagement with the rollers 68 to grip the media in order to pass it out of the printing zone 54 to the user.

The axis 72 extends generally from the first side 46 to the second side 48 of the platform 36. The feed roller 82, shaft 62, and axis 72 therefore extend substantially parallel to one another. A plurality of starwheel rollers 78 is secured to and freely rotatable relative to the platform 36. The starwheels 78 may be spaced a predetermined distance from one another along the axis 72. Each starwheel 78 is configured to guide the incoming media towards the starwheels 69 and the rollers 68 on the output shaft 62. The starwheels 78 on the axis 72 and the starwheels 69 adjacent to the shaft 62 are positioned generally with the same plane, which extends generally parallel to the plane 38 of the platform 36, to ensure that the media remains flat during printing.

A third gear 120 includes a plurality of gear teeth 122 and is rotatably connected to the base 34 via a pin 124. The third gear 120 connects the first gear 100 to the second gear 110. More specifically, the teeth 122 of the third gear 120 are in meshing engagement with both the teeth 102 of the first gear 100 and the teeth 112 of the second gear 110. When the first gear 100 is driven by the motor 84, the third gear 120 transmits rotation of the first gear to the second gear 110, thereby causing rotation of the output shaft 62 secured to the second gear. Accordingly, actuating the motor 84 both transmits incoming media to the printing zone 54 via the feed roller 82 and removes printed media from the printing zone via the rollers 68 on the output shaft 62.

A bracket 130 extends between the pin 124 on the base 34 and the first end 64 of the shaft 62. A bracket 130 also extends between another pin (not shown) on the base 34 and the second end 66 of the shaft 62. The brackets 130 maintain the shaft 62 in a parallel relationship with the feed roller 82 and maintain the spacing between the pins 124 and the shaft. The brackets 130 therefore ensure that the teeth 112, 122 of the second and third gears 110, 120 remain in meshing engagement with one another during operation of the printer device 30.

Figure 4:
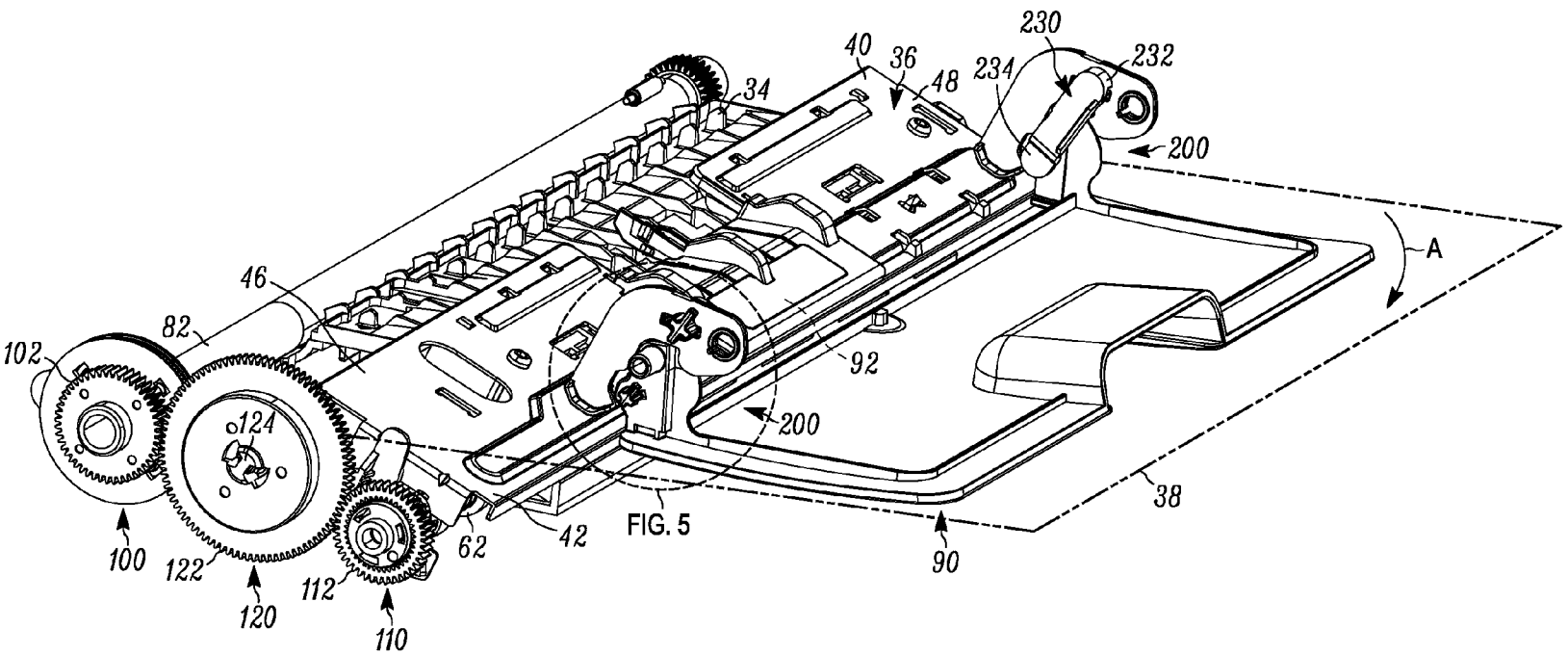
FIG. 4 is the printer device of FIG. 1 with the door in an open condition.
Figure 5:
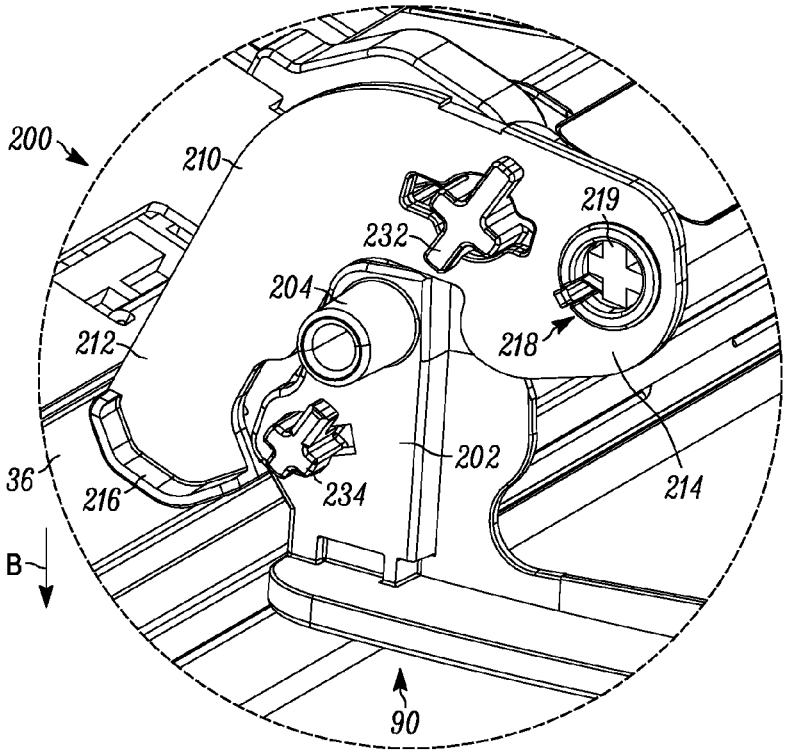
FIG. 5 is a schematic illustration of the mechanism of FIG. 3 when the door is in the closed condition.

Referring to FIGS. 4 and 5, a mechanism 200 connects the door 90 to the platform 36 for moving the platform between the first position within or parallel to the plane 38 and the second position angled relative to the plane. In the illustrated example embodiment, the mechanism 200 constitutes a linkage mechanism, e.g., a 4-bar linkage, although alternative mechanisms are contemplated. The mechanism 200 includes a pair of bars 210, 230 that cooperate with the door 90 and the platform 36 in order to translate pivotal or rotational movement of the door 90 into pivotal or rotational movement of the platform 36. The door 90 includes a pair of flanges 202 that are integrally formed with and extend substantially perpendicular to the remainder of the door. A projection or sleeve 204 extends from each flange 202 and cooperates with a corresponding recess or projection (not shown) on the housing 32 to pivotably connect the door 90 to the housing. In other words, the door 90 pivots about the sleeves 204 relative to the stationary housing 32 between the open condition and the closed condition.

The first bar 210 is generally L-shaped and extends from a first end 212 to a second end 214. The first end 212 includes a cam surface 216 that selectively applies a force to the platform 36 to move the platform from the first position to the second position. The second end 214 includes an opening 218 for receiving a projection 219 (see FIG. 5) on the housing 32 to rotatably connect the first bar 210 to the housing. More specifically, the opening 218 on the first bar 210 cooperates with the projection 219 on the housing 32 to allow the first bar to rotate about the projection relative to the stationary housing. The first and second ends 212, 214 of the first bar 210 are positioned generally on opposite sides of the sleeve 204 on the door 90.

The second bar 230 is generally straight and mechanically couples the first bar 210 to the door 90. More specifically, a first end 232 of the second bar 230 is secured between the ends 212, 214 of the first bar 210 and a second end 234 of the second bar is secured to the door 90 such that the door, first bar, and second bar are mechanically coupled to one another. When assembled, the first end 232 of the second bar 230 is positioned generally between the sleeve 204 on the door 90 and the opening 218 on the second end 214 of the first bar 210.

Figure 6A:
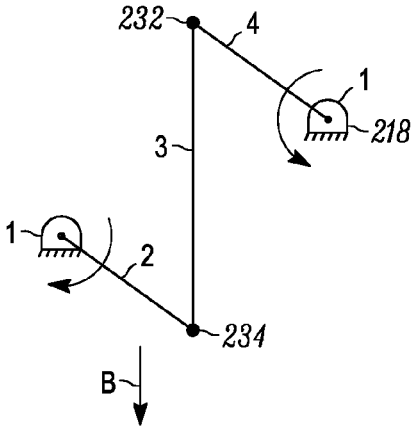
FIG. 6A is a kinematic representation of the mechanism of FIG. 3.

Collectively, the door 90, first bar 210, and second bar 230 form the 4-bar linkage of the mechanism 200 for translating movement of the door 90 into movement of the platform 36. The sleeve 204 on the door 90 and the projection 219 on the housing 32 together constitute the first or base link, i.e., non-moving joints, of the 4-bar linkage. The linear connection or line of action from the sleeve 204 on the door 90 to the second end 234 of the second bar 230 forms the second link. The second bar 230 forms the third link. The linear connection or line of action from the first end 234 of the second bar 230 to the projection 219 on the housing 32 forms the fourth link. The second link rotates about the sleeve 204, i.e., first/base link, the fourth link rotates about the projection 218, i.e., first/base link, and the third link rotates about the second link and fourth link. FIG. 6A provides a schematic, kinematic illustration of the 4-bar linkage mechanism 200 of FIG. 5, with each aforementioned link designated by (1), (2), (3), and (4), respectively. Due to this configuration, the mechanism 200 of the present disclosure translates pivotal or rotational movement of the door 90 into pivotal or rotational movement of the platform 36 in order to make the ink cartridge 94 more accessible to the user.

Referring to FIG. 1, in operation, the motor 84 is actuated to rotate the feed roller 82 in order to deliver incoming media to the printing zone 54 adjacent to the platform 36. If at any time the printer device 30 determines that the ink cartridge 94 is empty or sufficiently low on ink, the printer device notifies the user and the motor 84 for the feed roller 82 is deactivated. In order to remove the old ink cartridge 94 and replace it with a new one, the user pulls downward on the door 90 as indicated by arrow "A" in FIG. 4. Downward movement of the door 90 in this manner allows the door to pivot about the sleeves 204 relative to the housing 32 (clockwise as viewed in FIG. 4) from the closed condition to the open condition in order to provide access to the interior space 50 for removing/replacing the ink cartridge 94.

Figure 6B:
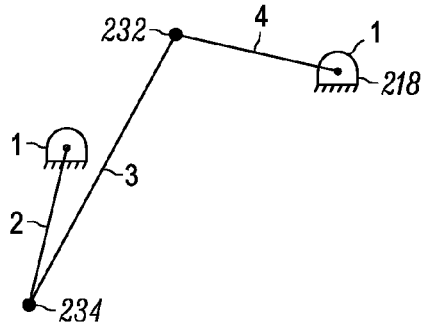
FIG. 6B is a kinematic representation of the mechanism of FIG. 5.

As the door 90 pivots clockwise, the mechanism 200 automatically translates this movement into downward pivotal movement of the platform 36 relative to the base 34 and plane 38. More specifically, clockwise pivoting of the door 90 causes the second end 234 of the second bar 230 to rotate clockwise about the sleeve 204, thereby causing the second link to rotate clockwise about the first/base link (see FIGS. 5 and 6B). As the second link rotates, the third link is pulled generally downward in the direction "B" towards the second link as the fourth link rotates counterclockwise about the first/base link. Moving the third link downward in the direction B causes the second bar 230 to pull the L-shaped first bar 210 downward towards the platform 36. The cam surface 216 of the first end 212 of the first bar 210 is thereby pulled downward in the direction B into engagement with the platform 36. It will be appreciated, however, that the cam surface 216 of the first bar 210 may alternatively be always engaged with the platform 36.

Figure 7:
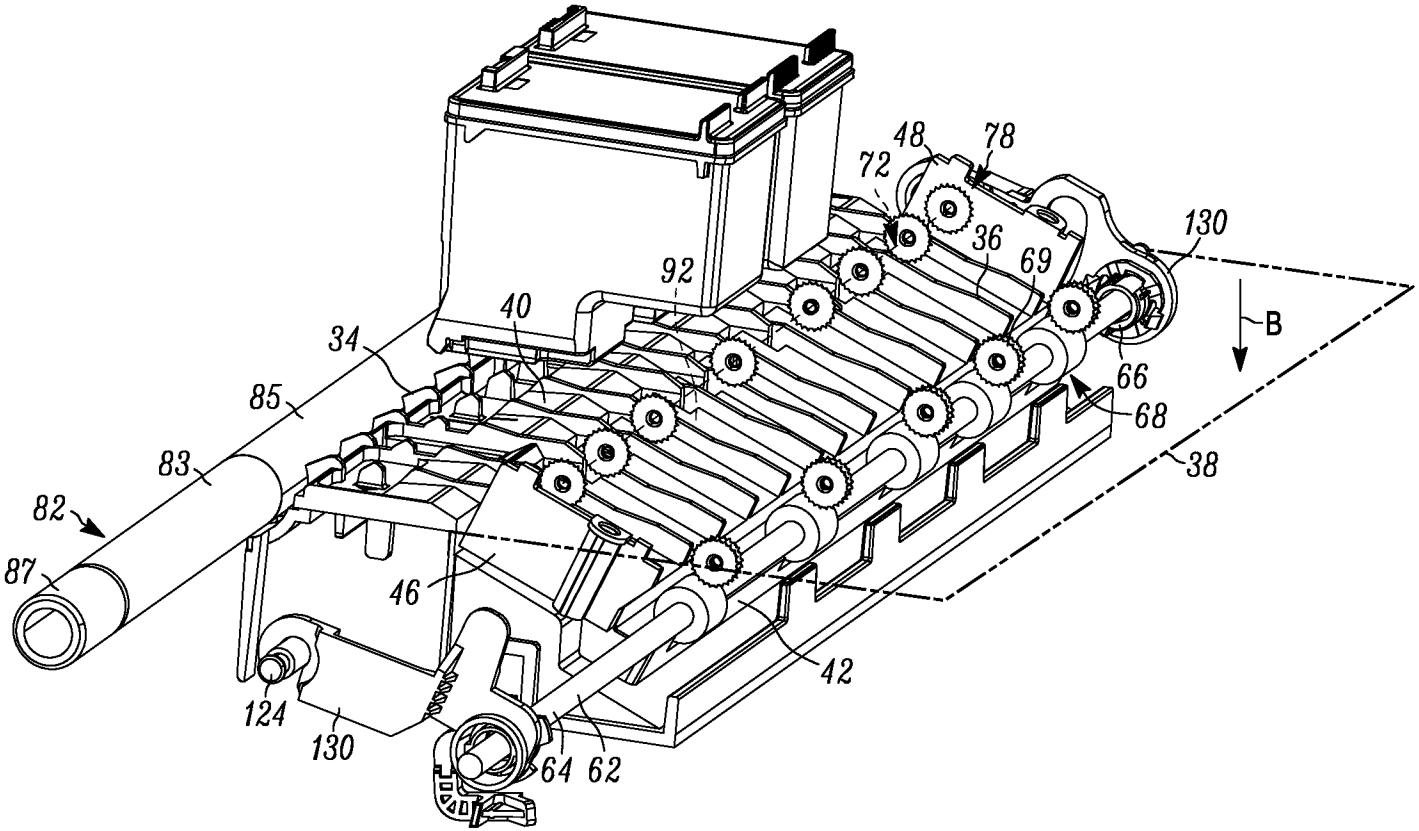
FIG. 7 is a schematic illustration of a portion of the printer device of FIG. 1 with the door in the open condition.

In any case, continued clockwise pivoting of the door 90 further pulls the first bar 210 downward in the direction B, causing the cam surface 216 to apply a downward force upon the platform 36. When the downward force of the cam surface 216 is sufficient to overcome the bias of the springs (not shown) the platform 36 is forced downward in the direction B. More specifically, referring to FIG. 7, the second end 42 of the platform 36 is forced downward in the direction B relative to the first end 40 such that the platform 36 pivots or rotates downward, i.e., clockwise as viewed in FIG. 7, relative to the base 34. The output shaft 62 and starwheels 69, 78, which are mounted on the platform 36, pivot downward with the platform relative to the base 34. Therefore, the second gear 110 also pivots downward with the platform 36 relative to the base 34. Since the brackets 130 extend between the ends 64, 66 of the output shaft 62 and pins 124, the shaft remains parallel to the axis 72 and feed roller 82 as it pivots downward with the platform 36. Furthermore, the brackets 130 maintain the teeth 112, 122 of the second and third gears 110, 120, respectively, in meshing engagement with one another as the second gear pivots downward with the platform 36.

The cam surface 216 forces the platform 36 downwards towards the second position until the door 90 reaches the fully open condition, e.g., the door and/or platform hit a hard stop on the base 34 that prevents further clockwise movement of the platform. The springs (not shown) or another biasing member (not shown) may hold the door 90 in the open condition. In the illustrated example, the mechanism 200 is in an over-center condition when the door 90 reaches the open condition such that the spring force is applied through the mechanism in a direction that helps maintain the door in the open condition. When the platform 36 reaches the second, downward position, the ink cartridge opening 92 in the platform likewise reaches a position that is angled downward relative to the plane 38. The ink cartridge opening 92 therefore pivots downward to a position that faces generally outward toward the open door 90 and the user. Accordingly, the ink cartridge 94 received in the opening 92 and retained by the cartridge carrier is presented toward the user to allow the user to more readily remove the old ink cartridge from the opening and place a new ink cartridge in the opening.

Once the ink cartridge 94 is replaced, the door 90 is pivoted counterclockwise into the closed condition and the mechanism 200 automatically returns the platform 36 to the first position within the plane 38. More specifically, counterclockwise pivoting of the door 90 about the sleeves 204 causes the second end 234 of the second bar 230 to rotate counterclockwise about the sleeves, thereby causing the second link to rotate counterclockwise about the first/base link.

As the second link rotates, the third link is pushed upwards away the second link in a direction opposite the direction B as the fourth link rotates clockwise about the first/base link. Moving the third link upwards causes the second bar 230 to push the L-shaped first bar 210 upwards away from the platform 36, thereby reducing the downward force of the cam surface 216 on the platform. As the downward force on the platform 36 decreases, the platform begins to move upward toward the first position with the help of the biasing springs (not shown). The door 90 continues to pivot towards the closed condition until the first bar 210 either disengages from the platform 36 or ceases to apply a downward force to the platform 36 sufficient to overcome any spring bias. The platform 36 returns to the first position when the door 90 reaches the fully closed condition. This places the ink cartridge opening 92 within the plane 38 and makes the printer device 32 ready for use with a new ink cartridge 94 installed.

Figure 8A:
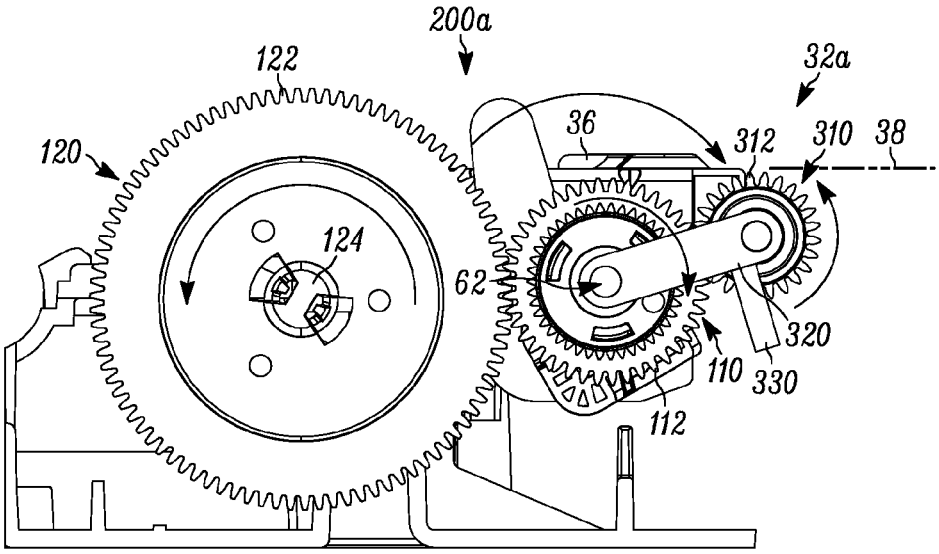
FIG. 8A is a schematic illustration of a mechanism for the printer device in a first condition in accordance with another aspect of the present disclosure.
Figure 8B:
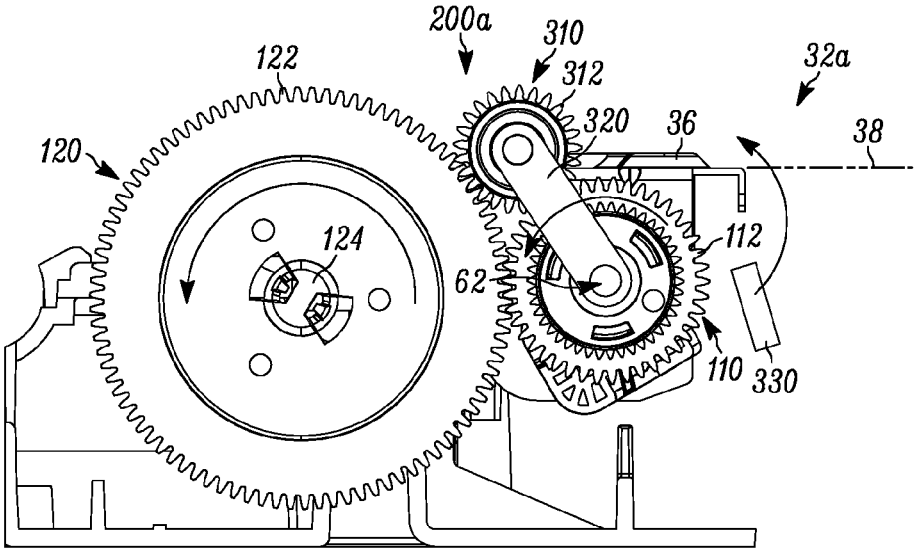
FIG. 8B is a schematic illustration of the mechanism of FIG. 8A in a second condition.
Figure 8C:
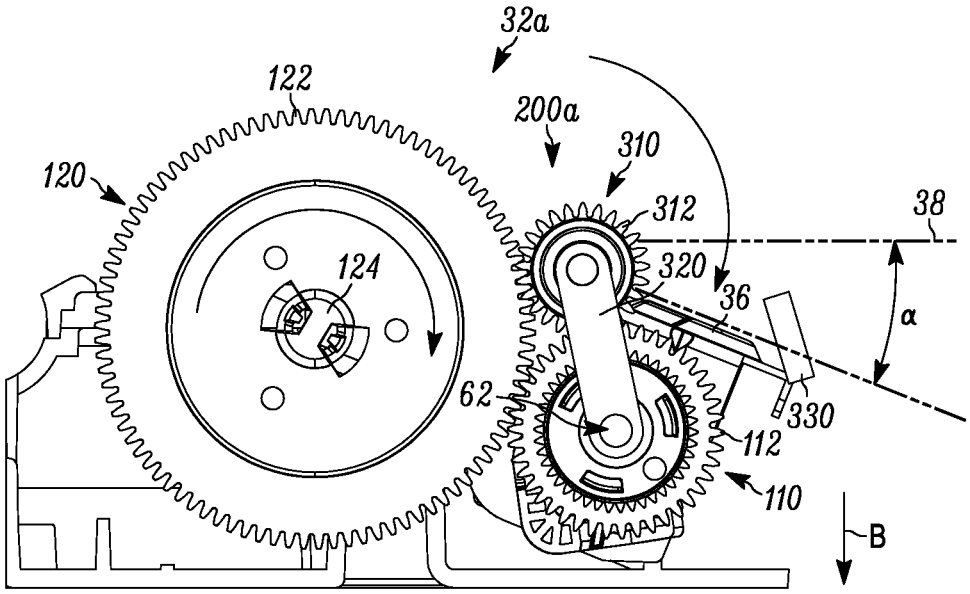
FIG. 8C is a schematic illustration of the mechanism of FIG. 8A in a third condition.

FIGS. 8A-8C illustrate a printer device 32*a* in accordance with another example embodiment of the present disclosure. The printer device 32*a* of FIGS. 8A-8C is similar to the printer device 32 of FIGS. 1-7 except that the mechanism 200*a* operates in response to the motor 84—not the opening or closing of the door 90. Features in FIGS. 8A-8C that are identical to features in FIGS. 1-7 are given identical reference numbers whereas features in FIGS. 8A-8C that are different from features in FIGS. 1-7 are given the suffix "a".

Referring to FIG. 8A, the mechanism 200*a* includes the motor-driven first gear 100 (not shown), second gear 110, the third gear 120, and a fourth gear 310 that includes gear teeth 312 for engaging the teeth 112 of the second gear. A bracket 320 connects the second gear 210 to the fourth gear 310 and ensures that the gears remain in meshing engagement with one another. The bracket 320 consists of two similar plates (not shown) that straddle the fourth gear 310 and are each mounted to the output shaft 62. A light drag force between the fourth gear 310 and the bracket 320 causes the bracket to rotate in-synchronization with the second gear 110 in both the clockwise and counterclockwise directions. The light drag force is accomplished with a sheetmetal spring (not shown) that lightly clamps the two plates of the bracket 320 together such that the fourth gear 310 drags lightly against each plate of the bracket.

Referring to FIG. 8A, when the motor 84 is actuated and the first gear 100 and feed roller 82 rotate clockwise, the third gear 120 rotates counterclockwise, thereby rotating the second gear 110 in the clockwise direction. The fourth gear 310 rotates in the counterclockwise direction in response to clockwise rotation of the second gear 110. The fourth gear 310 and bracket 320 rotate in-synchronization with the second gear 110 in the clockwise direction until the bracket engages a hard stop 330 on the housing 32 or other portion of the printer device 30*a*. In this condition, the platform 36 of the printer device 32*a* is in the first position in the plane 38 and media can be printed.

On command from firmware (not shown) of the printer device 32*a*, initiated by a user request by, for example, a button, a software window or by opening the door 90 to trigger a motion sensor switch (not shown), the media motor 84 moves in reverse to place the platform 36 and, thus, place the ink cartridge opening 92 in the second, lowered position. Referring to FIG. 8B, when the motor 84 reverses rotation, all the gears 100, 110, 120, 310 likewise reverse rotational direction such that the second gear 110 rotates in the counterclockwise direction. Since the second gear 110 is fixed to the output shaft 62, which is mounted to the platform 36, the second gear remains relative to the platform. The fourth gear 310 and bracket 320, however, rotate in-synchronization with the second gear 110, i.e., in the counterclockwise direction, until the teeth 312 of the fourth gear engage the teeth 122 of the third gear 120, which causes the gears 110, 120, 310 to lock together. In other words, none of the gear 110, 120, 310 can rotate relative to one another in the configuration shown in FIG. 8B. At this point, the platform 36 remains in the first position in the plane 38 and the printer device 32*a* can print media.

Referring to FIG. 8C, further reverse rotation of the motor 84 and, thus, further clockwise rotation of the third gear 120 causes the platform 36 to pivot or rotate into the second position angled downward relative to the plane 38. More specifically, since the gears 110, 120, 310 are locked together, further clockwise rotation of the third gear causes the second gear, fourth gear, and bracket 320 to rotate about the pin 124 as a single unit in the clockwise direction about the rotating third gear. Since the output shaft 62 is mounted to both the second gear 110 and platform 36, clockwise rotation of the second gear moves the platform downward and into the second position at an angle a relative to the plane 38. Accordingly, the ink cartridge opening 92 is rotated downward to a position facing the user to facilitate removal and replacement of the ink cartridge 94. At this time, the motor 84 is placed in a hold mode to keep the platform 36 in the second position while the user changes the ink cartridge 94.

When the user indicates that they have completed replacing the ink cartridge 94, the media motor 84 returns to normal, forward rotation, thereby raising or rotating the platform 36 upward towards the first position within the plane 38. As the platform 36 rises, the springs (not shown) that normally bias the platform towards the first position act to back-drive the second gear 110 into the fourth gear 320 and the third gear 120. This back-drive creates tooth-to-tooth friction between the gear teeth 112, 122, 312, which keeps them locked together until the platform 36 reaches the first position within the plane 38 at which time the back-drive force is relieved. At this point, the fourth gear 310 disengages from the third gear 120 and the fourth gear and bracket 320 become free to rotate together in the clockwise direction with the second gear 110 until the bracket again abuts the hard stop 330. The mechanism 200*a* thereby returns to the print-ready configuration shown in FIG. 8A.

If it is desirable to perform other functions using reverse rotation of the motor 84 without lowering the platform 36 into the second position, the base 34 or some other mechanism can be used to interpose another rotation stop (not shown) of the bracket 320, thereby limiting its rotation such that the fourth gear 310 cannot reach the third gear 120. In that case, the fourth gear 310 would not be utilized. Furthermore, if those other functions using reverse motor 84 rotation had small angular rotation requirements, the motion of the bracket 310 moving from the rotation stop 330 toward the third gear 120 causes a delay before the fourth gear comes into play, even without a second rotation stop.

The preferred embodiments of the disclosure have been illustrated and described in detail. However, the present disclosure is not to be considered limited to the precise construction disclosed. Various adaptations, modifications and uses of the disclosure may occur to those skilled in the art to which the disclosure relates and the intention is to cover hereby all such adaptations, modifications, and uses which fall within the spirit or scope of the appended claims.

Having described the disclosure, the following is claimed:

1. A printer device comprising:

a housing defining an enclosed interior space;

a platform having a first position extending along a plane within the enclosed interior space for receiving printing media; and a mechanism for selectively applying a force to the platform to move the platform to a second position at an angle relative to the plane.

2. The printer device of claim 1 further comprising a door connected to the housing and movable relative to the housing between a first position that encloses the interior space and a second position providing access to the interior space, the mechanism being secured to the door and selectively applying the fore to the platform in response to movement of the door to the second position.

3. The printer device of claim 2, wherein the mechanism is a linkage mechanism comprising:

a first link secured to the housing; and a second link secured to the first link and to the door, wherein movement of the door from the first position to the second position causes the second link to move the first link relative to the housing and apply the force upon the platform to urge the platform into the second position.

4. The printer device of claim 3, wherein the first flak has a first end pivotably connected to the housing and a second end having a cam surface for urging the platform into the second position.

5. The printer device of claim 1, wherein the platform comprises a deck that supports both a rotating shaft for driving a plurality of first rollers and a plurality of second rollers rotatably mounted to the deck along an axis.

6. The printer device of claim 5 further comprising a feed roller for feeding media to the platform, the feed roller being driven by a motor.

7. The printer device of claim 6 further comprising a first gear secured to the feed roller, a second gear secured to the rotating shaft, and a third gear that transmits rotation of the first gear to the second gear.

8. The printer device of claim 7, wherein the rotating shaft and second gear move with the platform between the first position and the second position, a bracket extending between the second gear and the third gear to maintain the second gear and third gear in meshing engagement while the platform moves between the first position and second position.

9. The printer device of claim 7, wherein the mechanism includes a fourth gear rotatable with the second gear, the feed roller rotating in a first direction to place the fourth gear out of meshing engagement with the third gear in order to move media over the platform, the feed roller rotating in a second direction opposite the first direction to place the fourth gear into meshing engagement with the third gear for moving the platform into the second position.

10. The printer device of claim 9, wherein rotating the, feed roller in the second direction causes the second, third, and fourth gears to lock together, the third gear rotating to move the second and fourth gears as a unit to move the platform into the second position.

11. The printer device of claim 1, wherein the platform includes a print cartridge opening such that the platform is placed in the second position in order to access a print cartridge within the print cartridge opening for installation into or removal from the printing device.

12. The printer device of claim 1 further comprising at least one biasing member for biasing the platform into the first position.

13. The printer device of claim 1, wherein the platform has a cartridge receiving opening configured to receive a cartridge, wherein moving of the platform to the second position angles the cartridge receiving opening downwards relative to the plane.

14. A printer device comprising:

a housing defining an interior space;

a door connected to the housing and selectively rotatable between a first position enclosing the interior space and a second position providing access to the interior space;

a platform having a first location extending along a plane within the interior space for receiving printing media, the platform having a cartridge receiving opening configured to receive a cartridge; and a mechanism secured to the door for selectively engaging the platform to rotate the platform to a second location at an angle relative to the plane in response to rotation of the door to the second position, wherein rotating the platform to the second location angles the cartridge receiving opening downwards relative to the plane.

15. The printer device of claim 14, wherein the mechanism is a linkage mechanism comprising:

a first link having a first end pivotally secured to the housing and a second end having a cam surface for urging the platform into the second location; and a second link secured to the first link and to the door, wherein movement of the door from the first position to the second position causes the second link to move the first link relative to the housing and apply a force upon the platform to urge the platform into the second location.

16. The printer device of claim 14, wherein the platform comprises a deck that supports both a rotating shaft for driving a plurality of first rollers and a plurality of second rollers rotatably mounted to the deck along an axis.

17. The printer device of claim 16 further comprising a feed roller for feeding media to the platform, the feed roller being driven by a motor, a first gear being secured to the feed roller and a second gear being secured to the rotating shaft, and a third gear that transmits rotation of the first gear to the second gear.

18. The printer device of claim 17, wherein the rotating shaft and second gear with the platform between the first location and the second location, a bracket extending between the second gear and the third gear to maintain the second gear and third gear in meshing engagement while the platform moves between the first location and second location.

19. method of increasing the accessibility of an ink cartridge in a printer device comprising:

providing a platform having an ink cartridge receiving opening configured to receive the ink cartridge, the platform having a first position extending along a plane within a housing of the printer device;

providing a linkage mechanism that connect, the platform to a door of the printer device that selectively provides access to the ink cartridge; and opening the door to cause the linkage mechanism to apply a force upon the platform in order to urge the platform into a second position at an angle relative to the plane, wherein moving the platform to the second position angles the ink cartridge receiving opening downwards relative to the plane.

* * * * *

UNITED STATES PATENT AND TRADEMARK OFFICE

CERTIFICATE OF CORRECTION

PATENT NO. : 8,651,652 B2
APPLICATION NO. : 13/457667
DATED : February 18, 2014
INVENTOR(S) : Kieran B Kelly et al.

It is certified that error appears in the above-identified patent and that said Letters Patent is hereby corrected as shown below:

In the Claims:

In column 9, line 12, in Claim 2, delete “fore” and insert -- force --, therefor.

In column 9, line 23, in Claim 4, delete “flak” and insert -- link --, therefor.

In column 9, line 52, in Claim 10, delete “the,” and insert -- the --, therefor.

In column 10, line 44, in Claim 18, after “gear” insert -- move --.

In column 10, line 49, in Claim 19, before “method” insert -- A --.

In column 10, line 56, in Claim 19, delete “connect,” and insert -- connects --, therefor.

Signed and Sealed this
Tenth Day of June, 2014

Michelle K. Lee

Michelle K. Lee
*Deputy Director of the United States Patent and Trademark Office*